US006425422B1

(12) United States Patent
Trebbi

(10) Patent No.: US 6,425,422 B1
(45) Date of Patent: Jul. 30, 2002

(54) DOSING MACHINE FOR HARD GELATIN CAPSULES

(75) Inventor: Roberto Trebbi, San Lazzaro di Savena (IT)

(73) Assignee: I.M.A. Industria Macchine Automatiche S.p.A., Ozzano Emilia (IT)

( * ) Notice: Subject to any disclaimer, the term of this patent is extended or adjusted under 35 U.S.C. 154(b) by 0 days.

(21) Appl. No.: 09/787,533

(22) PCT Filed: Oct. 29, 1999

(86) PCT No.: PCT/EP99/08224

§ 371 (c)(1),
(2), (4) Date: Mar. 20, 2001

(87) PCT Pub. No.: WO00/32474

PCT Pub. Date: Jun. 8, 2000

(30) Foreign Application Priority Data

Dec. 3, 1998 (IT) ..... BO98A0681

(51) Int. Cl.[7] ..... B65B 1/04

(52) U.S. Cl. ..... 141/67; 141/71; 141/12; 141/144

(58) Field of Search ..... 141/5, 6, 11, 12, 141/67, 71, 83, 73, 103, 144, 173, 175, 145, 146

(56) References Cited

U.S. PATENT DOCUMENTS

| | | | | |
|---|---|---|---|---|
| 3,847,191 A | * | 11/1974 | Aronson | 141/12 |
| 4,501,307 A | * | 2/1985 | Moser et al. | 141/12 |
| 5,855,233 A | * | 1/1999 | Bolelli | 141/103 |
| 5,971,037 A | * | 10/1999 | Ansaloni | 141/100 |
| 6,098,675 A | * | 8/2000 | Runft | 141/71 |

* cited by examiner

*Primary Examiner*—Steven O. Douglas
(74) *Attorney, Agent, or Firm*—Larson & Taylor PLC

(57) ABSTRACT

A carousel carries a holder with product to be dosed and includes a lower disc fitted with peripheral sets of dosing holes into which plungers insert and press in successive stages doses of product. The carousel also includes fixed bodies and radially moveable bodies with seatings for supporting tops and bottoms of capsules. Lower bodies support extensions that close the lower ends of dosing holes in the successive stages, and opposing members are provided to support the moveable assemblies. With only one dosing disc, it is possible to form doses of product of different densities and masses and of different heights by varying the heights of the sets of plungers. A chamber defined by a sweeper wall and containing no product is provided with a plunger station that completes the pressing of this final quantity of product, before a subsequent plunger station discharges the product into the capsule bottoms.

18 Claims, 5 Drawing Sheets

9
8
107
7
K1
C1
C2
11'
109
2
101
12
15
4
6
1
5
13
204
10
111
14
K6
104
11
9'
109'

DOSING MACHINE FOR HARD GELATIN CAPSULES

BRIEF SUMMARY OF THE INVENTION

The invention relates to disc- and plunger-type dosing machines with intermittent operation that are particularly suitable for packaging doses of loose product in hard gelatin capsules or other containers. In this specific field of the art the invention has to do with improvements for making such machines more reliable, more accurate and easier to use when varying the volume of the doses to be produced, as well as for limiting product losses and for eliminating machine component wear.

BRIEF DESCRIPTION OF SEVERAL VIEWS OF THE DRAWINGS

These and other features of the invention will be made clear in the following description of a preferred embodiment thereof, illustrated purely by way of non-restrictive example in the figures of the attached sheets of drawings, in which.

DETAILED DESCRIPTION OF THE INVENTION

Figure 2:
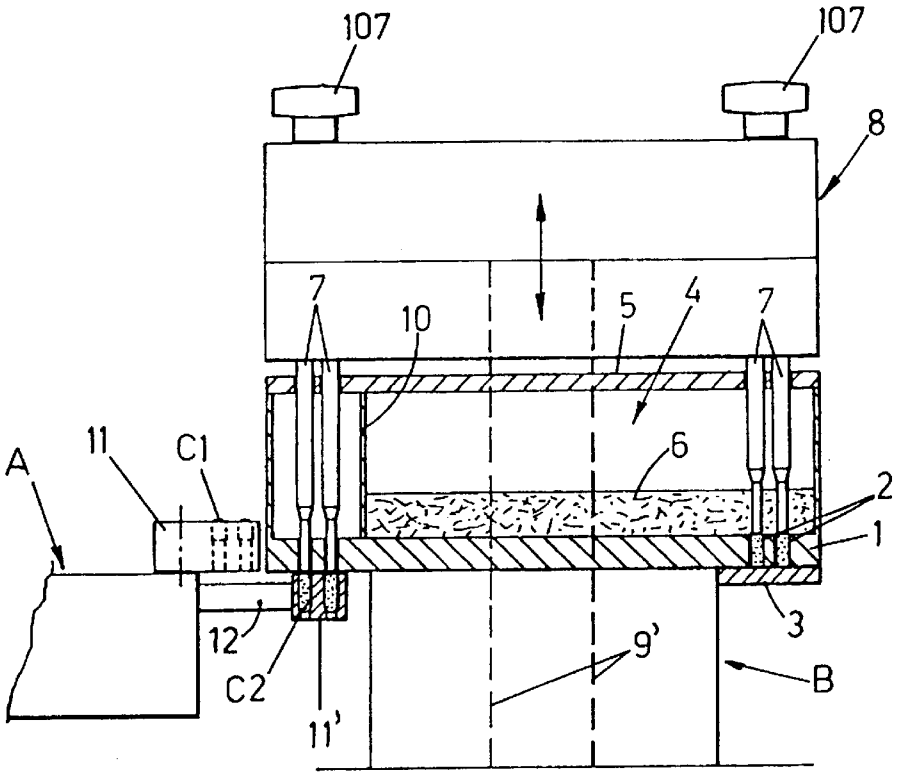
FIG. 2 illustrates further details of the known machine as viewed on the section plane marked II—II in FIG. 1.
Figure 1:
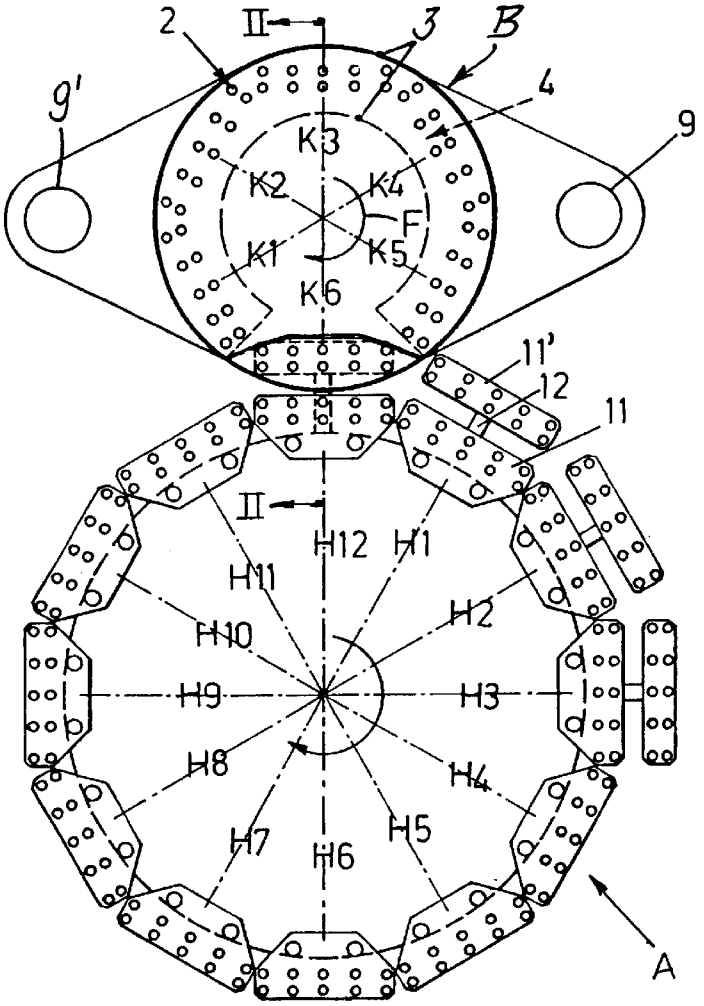
FIG. 1 is a diagrammatic plan view from above of the machine according to the prior art referred to herein.
Figure 3:
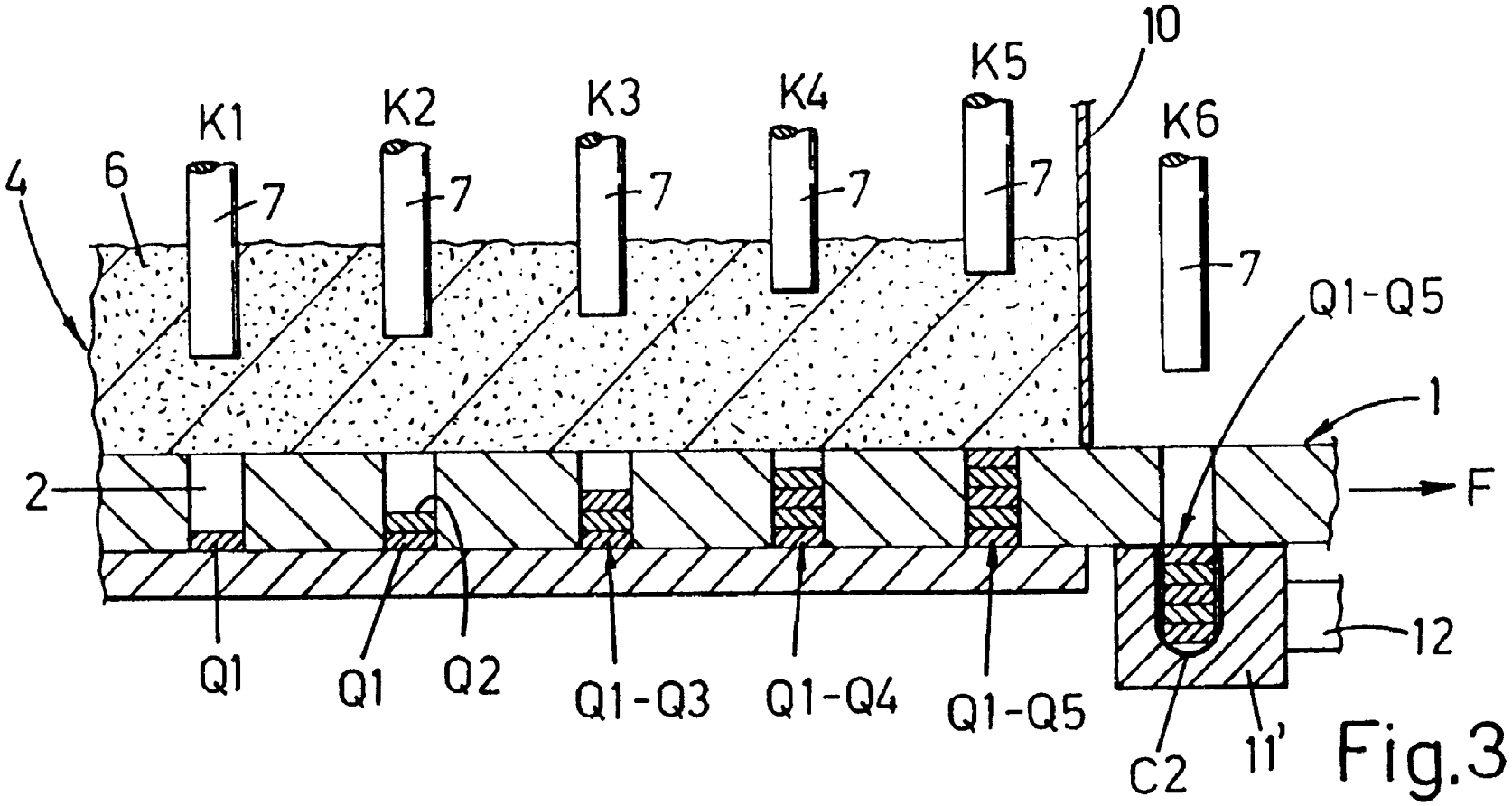
FIG. 3 illustrates diagrammatically and in a rectilinear development the successive stations for the forming and discharging into the capsules of a composite dose of product by the machine seen in FIGS. 1 and 2.

FIGS. 1, 2 and 3 show that the machine according to the prior art is fundamentally composed of two carousels A and B on vertical axes, which both rotate in the same direction as indicated for example by the arrows F, with an intermittent movement whose amplitude is equal to the angle occupied by each of the stations of the carousels. Carousel B is employed in forming the doses of product and may for example have six angularly equidistant units, so that it rotates in steps of sixty degrees, while carousel A which is employed in handling the gelatin capsules has twelve angularly equidistant units and therefore rotates in steps of thirty degrees. This all takes place in such a way that one unit of this carousel is lined up cyclically with one unit of the neighbouring carousel.

Carousel B comprises a horizontal disc 1 on the periphery of which are six sets of vertical passages or holes 2 passing through the full thickness of the disc, their dimensions being a direct function of the mass of whatever doses of product are to be packaged in the capsules, and a function of the dimensions of the capsules themselves. When these characteristics are varied, in known machines the disc 1 has to be changed. In each set of holes 2 the holes may be, for example, arranged in two rows parallel with each other and perpendicular to the radius of the carousel and the holes of one row are aligned with the holes of the adjacent row.

The disc 1 rotates in the direction of the arrow F and the holes 2 are normally closed at the bottom by a fixed part-annulus 3 that is interrupted in the section where a set of holes of carousel B meet one unit of carousel A. The disc 1 forms the base of a holder 4 whose side wall may rotate, for example, as one piece with the same disc 1, which is covered at the top by a fixed cover 5 and in whose interior a precise layer of the loose product 6 to be packaged in precise doses into the capsules is maintained by means that are not illustrated. The product in question is in certain cases of vegetable origin, of filamentary type and has difficulty entering the holes 2 under gravity. Passing through the cover 5 are a plurality of sets of vertical plungers 7. These form the six stations of carousel B, are placed in the same layout as the sets of holes 2, have a lower portion of a diameter such as to pass with sufficient precision through the same holes 2 and have heights that are individually adjustable by means of the adjusters 107. The sets of plungers 7 are mounted in such a way that they can be adjusted for height on a turret 8 which by means of opposing vertical slides 9, 9' runs on associated guides 109, 109' (see FIG. 5) and which is raised and lowered at the appropriate times. The set of holes 2 that cyclically meets a unit of carousel A, in the station K6, is positioned in a section of the holder 4 which has no product owing to the presence in the latter of a sweeper wall 10 whose concave face is innermost and which is fixed e.g. to the cover 5.

Each unit of carousel A is provided with two superimposed bodies 11, 11' with bushes or seatings to hold the hard gelatin capsules, with the same layout as the sets of holes 2 in the disc 1 of carousel B. The upper body 11 with the larger-diameter seatings, is designed to contain the tops C1 of the capsules is fixed to carousel A, possibly with means of vertical displacement, while the lower body 11', which has the smaller-diameter seatings to contain the bottoms C2 of the capsules, is connected to the carousel by means of radial slides 12 which in response to a signal move the body 11' away from the body 11 and position it under the disc 1 of carousel B.

The operation of this known machine is summarized in the diagram, FIG. 3. At each cyclical stopping of the disc 1, see also FIG. 2, corresponding sets of holes 2 are positioned in stations K1, K2, K3, K4, K5 and K6 of carousel B in line with corresponding sets of plungers 7 which at the right time are driven down in order to press, first into the holes 2, corresponding quantities of product as indicated by Q1, Q2, Q3, Q4, Q5 into stations K1 to K5, until these holes are completely filled and until completion of the compression of the composite dose of product in station K5. The sets of holes 2 reach station K6 of carousel B filled with product after passing the sweeper wall 10 and in this station they are lined up with plungers 7 situated above them and corresponding bottoms C2 supported beneath them by a moving body 11' of a peripheral unit of carousel A, so that when the said plungers 7 fall, the doses of product Q1–Q5 are expelled from the holes 2 and transferred into the capsule bottoms C2. The plungers 7 then return to the raised position of FIG. 3, the disc 1 rotates 60° and the cycle described above repeats.

In stations H1, H2 and H3 of carousel A, the lower bodies 11' with the capsule bottoms filled with the product taken from carousel A are still in the extended position for the stages of separation of rejects and, if required, for insertion into the same capsule bottoms of other products, for example time-release constituents or tablets. In the next station H4 the lower body 11' is lined up with the upper body 11 of carousel A and the capsules are closed. In the succeeding stations H5 and H6 the capsules are expelled from carousel A. In station H7 the seatings of the bodies 11, 11' are cleaned and in the succeeding stations H8 and H9 new empty capsules are supplied to carousel A and opened in the next station H10. On passing from station H11 to station H12 the lower body 11' with the capsule bottoms is extended and lined up with station K6 (already considered) of carousel B.

In the known machine as in FIGS. 1, 2 and 3 the following drawbacks are encountered: the doses of product pressed into the holes 2 of the disc 1 during the cyclical rotation of the disc rub over the fixed part-annulus 3 and eventually create furrows on the latter through which some of the product can be lost and which falsify the volume of the doses. The metal dust removed by wear from the part-annulus 3 contaminates the doses of product. Further leakages of product occur through the small tolerance which must necessarily exist between the disc 1 and the fixed part-annulus 3 to enable the disc to rotate. When the sets of holes 2 with the doses of product reach station K6 of carousel B, underneath them is the body 11' with the capsule bottoms. More product can be lost through the gap between the disc 1 and the said body 11'. During positioning of the product-containing holes 2 over the body 11', these holes 2 travel over all the seats containing the capsule bottoms and can lose product at random into the bottoms, falsifying the doses. Another drawback arises from the need to change the disc 1 when modifying the doses of product that are to be formed, even for small modifications of dose. Attempts have been made to use discs with telescopic seatings whose height can be varied as a function of the doses of product to be produced, but without success when using loose products which stick to the handling means, because in this case the system tends to seize up and its performance declines.

The invention aims to overcome these and other drawbacks of the prior art with the following proposal for a solution. The carousel on which the doses of product are formed is integrated into the carousel on which the capsules are handled, and underneath the disc with the sets of dose forming holes are closure bodies connected to the movable capsule bottom handling bodies, in such a way that during the rotation of the present composite carousel there is no relative movement or sliding friction (as however occurs in the prior art) between the parts defining the dosing seatings. The sets of holes of the dosing disc are suitably staggered relative to each other and the seatings for holding the gelatin capsules are arranged with the same layout, so that when the lower unit that closes the said holes is moved radially to line up these holes with the bottoms of the capsules, each hole containing the product opens only over the seating with the dedicated capsule bottom. Also envisaged is the possibility of using a single disc to make doses of different mass by varying the amplitude of the stroke of the sets of plungers, using the last set of plungers that operates in the holder to fill the dosing holes flush with the upper mouth and providing on the outside of the final sweeper wall, not only the sets of plungers for discharging the doses of product but also, before this, at least one set of plungers that presses the quantity of powder present in the holes in order to give it the compactness and height required for correct transfer into the capsules and to give them the density required by the pharmacological specifications.

Figure 4:
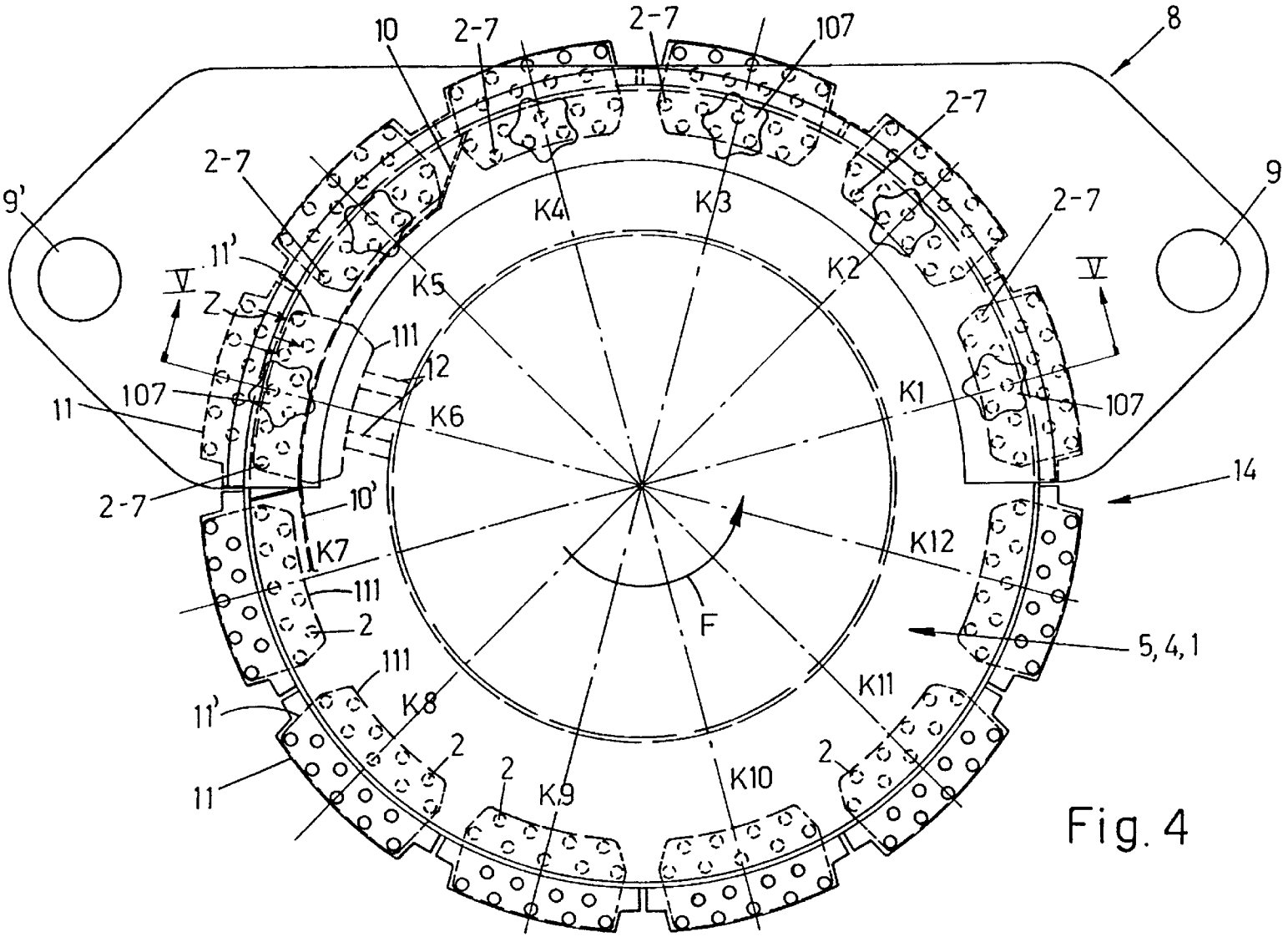
FIG. 4 is plan view from above of the machine according to the invention.

These and other features of the invention, and the advantages procured thereby, will be made clearer in the following description which refers to FIGS. 4 and 5. In these FIGS. 13 denotes a fixed vertical shaft on which rotates the composite carousel 14 which rotates, for example, anticlockwise and supports at the top the disc 1 with the sets of dosing holes 2 set out at suitable equal intervals and in the appropriate number, for example twelve sets. In FIG. 4 it can be seen that in each set of holes 2, the holes are arranged in a plurality of rows, for example two rows, and the holes of one row are staggered with respect to the holes of the adjacent row. Fixed radially around and projecting from the periphery of the disc 1 are the bodies 11 that carry the seatings for holding the capsule tops C1, which however allow the capsule bottoms to pass underneath and which are open at the bottom. Under these bodies are the moveable bodies 11' that carry the seatings for holding the capsule bottoms C2, seatings which are open at the bottom for the passage of the fingers (of known type) used to open the capsules by suction, extracting the bottoms from the tops which remain in the upper seatings of the body 11 and for the passage of the final lifting fingers for closure of the capsules and for their expulsion from the carousel seatings. This is all in accordance with known solutions which are therefore not illustrated.

The bodies 11' are supported by the slides 12 which are protected by boots with vent ways and which slides by known means on the carousel 14 can carry the seatings of the bodies 11' into line with the seatings of the upper bodies 11, or with the sets of holes 2 of the dosing disc, or vice versa. In the machine according to the invention, the seatings of the bodies 11 and 11' are arranged with the same layout of the sets of holes 2 as the dosing disc 1, for purposes which will be indicated later. In the present machine, the bodies 11' are also characterized by comprising an extension 111 in the direction of the carousel 14, which extension 111 is flat and such that when these bodies 11' have their seatings in line with those of the upper body 11, as illustrated on the right-hand side of FIG. 5, the upper face of the extension 111 is brought into close contact with the lower face of the annular portion 101 of the disc 1 where the lower ends of the dosing holes 2 emerge, this portion 101 being made lower by a suitable amount than the adjoining part of the lower face of the same disc in such a way as to limit the sliding friction between the parts when the lower assembly 111, 11' is moved by means of the slides 12.

It should be pointed out that during the stages in which each set of holes 2 in the dosing disc is closed at the bottom by its particular extension 111, the latter extension or the slides 12 carrying it rest for example on rollers with horizontal axes 15 supported by the structure 109 of the aforementioned turret of the plungers. This ensures close contact between the parts 111 and 101. On the other hand, when the lower assembly 111, 11' has to be moved to the final work stations of the machine, in order to line up the capsule bottoms C2 first with the dosing holes 2 and then with the seatings of the body 11 with the capsule tops C1, the said rollers 15 are not provided, so that the said assembly can be moved with limited sliding friction, possibly owing also to the possibility of allowing a small amount of vertical play on the slides 12, which allows a slight detachment of this assembly from the surface 101. This slight play, which may be for example of the order of tenths or hundredths of a millimeter, is then eliminated in the operation stations by the intervention of the rollers 15. It will be understood that the rollers 15 can be replaced by supports of equivalent type. For example, the rollers could be connected underneath the moveable unit 111-11' and could run on fixed tracks. Alternatively, the various operating stations could have one or more moveable opposing members that are lowered during the rotation of the carousel and raised after this rotation.

As in the known solution, so in the present machine the dosing disc 1, of which more later, forms the base of the holder 4 containing the product 6 to be dosed, the holder being in this case of toric shape, with the outer lateral wall 104 integral for example with the disc 1. The cover 5, with the inner lateral wall 204 of the holder 4 may for example be integral with the shaft 13 which in turn is fixed. Suitable means (not illustrated as being known) are provided to introduce the product to be dosed into the holder 4 and to maintain a uniformly distributed layer of predetermined height.

The carousel 14 is surmounted in part, for example through 180°, by a turret 8 with vertical track and slide sets on opposite sides 9, 9', 109, 109'. Mounted on this turret with the interposed height adjusters 107 are the sets of vertical downward-pointing plungers 7, which pass through the apertures in the cover 5 and terminate inside the holder 4 in line with corresponding holes of the sets of dosing holes 2 and at an adjustable distance from the disc 1. In the present example the sets of plungers 7 number, for example, six and are distributed in stations K1 to K6. The last two sets of plungers that operate in stations K5 and K6 are not immersed in the product 6, unlike the others, but are out of the product because of the presence in the holder of a sweeper wall 10, possibly fixed to the cover 5 and whose concave face is innermost, as indicated in FIG. 4 in broken lines.

The machine as described works as follows: in stations K11 and K12 the moveable unit 111, 11' is in the extended position as illustrated on the right-hand side of FIG. 5, unsupported by rollers 15, and the seatings of the assembly 11, 11' are supplied with the closed capsules which are then opened for example in stations K11, K12. In stations K1, K2, K3, K4 the sets of holes 2 that alternate cyclically in these stations, with the associated opposing members 111 supported by rollers 15, are filled with product in the following manner. Above them in stations K1, K2, K3 the sets of plungers 7 compress corresponding quantities of product into the sets of holes 2, as indicated in FIG. 6 at Q1, Q2, Q3. By varying the initial height of the sets of plungers 7 in stations K1, K2 and K3, then, because the plungers execute equal descent strokes owing to their connection to the common turret 8, the adjustment referred to above has the effect of varying the bottom end of the stroke of each plunger. The lower the bottom ends of the strokes of the plungers, the greater the density of the quantities of product Q1, Q2, Q3 pressed in succession into the holes 2 and the greater the amount of space in the holes 2 which is left free of these quantities of pressed product. The plungers 7 of stations K1, K2 and K3 may be fitted with selective adjusters and/or with a unified adjuster. In station K4 the corresponding plungers 7 are adjusted to execute a stroke which fills with product the still free part of the holes 2 with a quantity of product Q4 that is less dense than the previous doses Q1–Q3. In the next station K5 the corresponding plungers 7 compress the quantity of product Q4 provided in station K4 and possibly subject the complete dose Q1–Q4 to further compression in order to give it the desired density and height. It will be obvious that the machine according to the invention offers the advantage of forming, by means of a single dosing disc 1, doses of product whose density, mass and height dimensions vary over a wide range.

Figure 5:
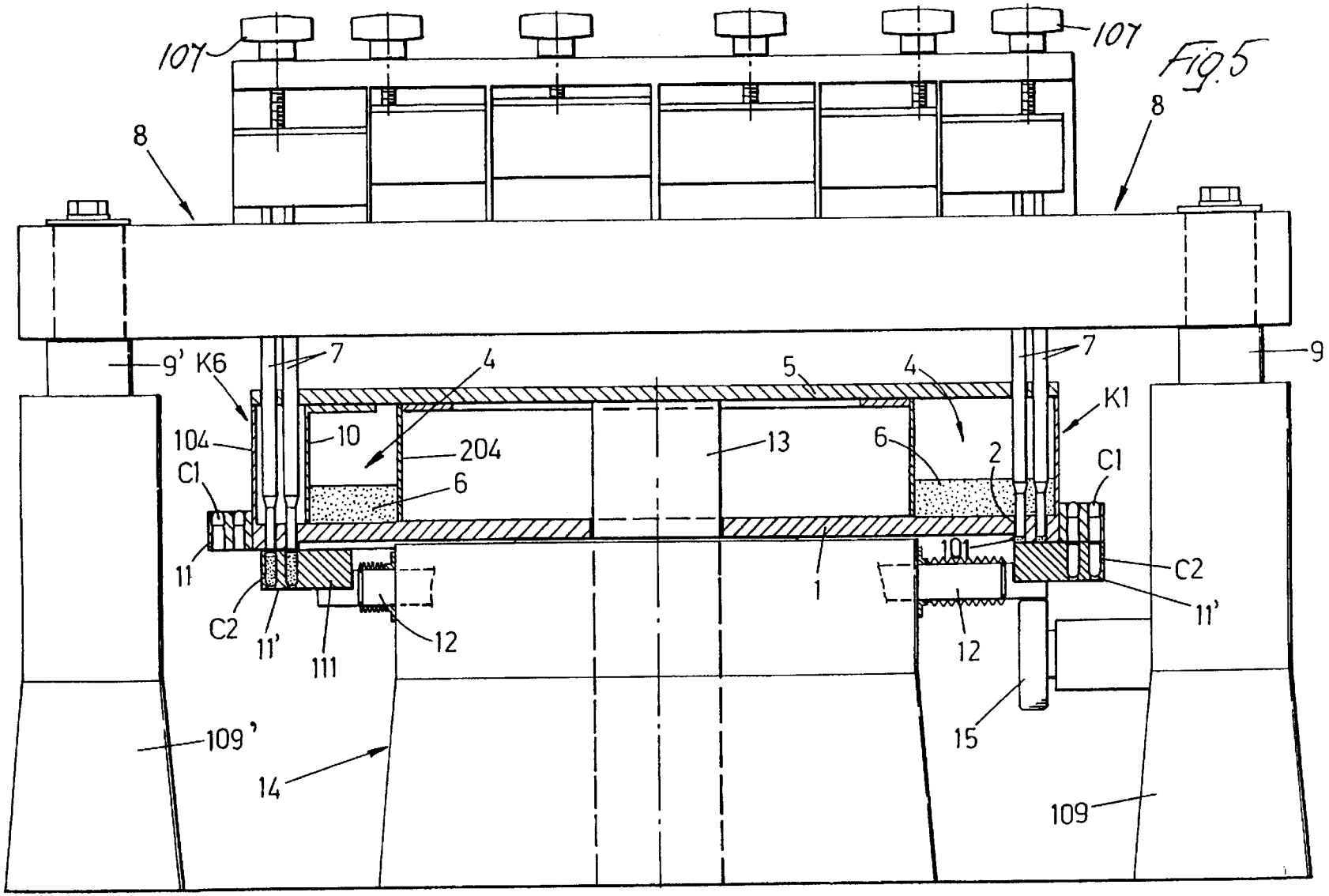
FIG. 5 illustrates further details of the machine shown in FIG. 4 in section on plane V—V.
Figure 6:
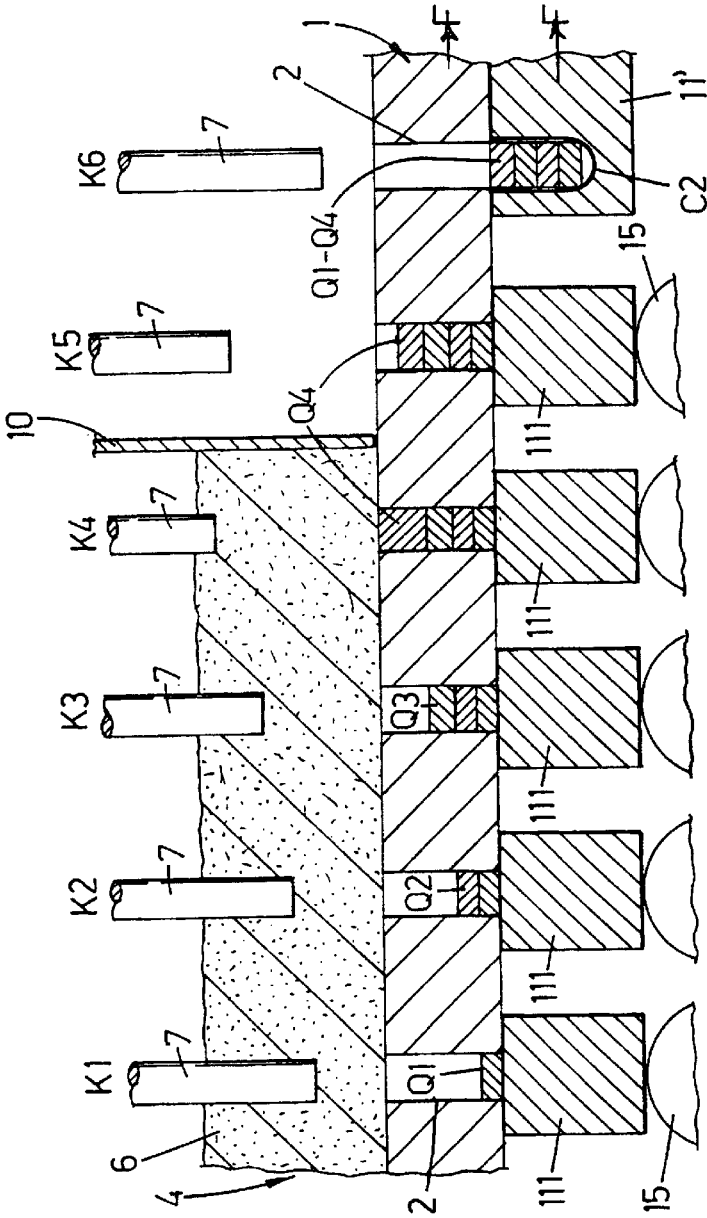
FIG. 6 illustrates diagrammatically and in a rectilinear development the successive stations in which the machine as shown in FIGS. 4 and 5 forms and discharges a dose of product.

In station K6 the moveable unit 11'–111 places itself in the condition illustrated on the left-hand side of FIG. 5, with the capsule bottoms C2 lined up with and underneath the holes 2 of the disc 1 with the previously formed doses of product and the plungers 7 of this station K6 transfer the doses of product from the holes 2 to the capsule bottoms C2. In FIG. 4 it is clear that when the moveable unit 111, 11' is moved radially as indicated by the arrows Z, the effect of the staggering of the holes 2 of the dosing disc and the corresponding staggering of the seatings of the said unit with the capsule bottoms is for each bottom to open exactly underneath its respective hole, without passing beneath other holes as happens in the prior art. It is in this station K6 that rejects are picked out, i.e. incorrectly opened capsules are removed from the body 11, or doses of product fed into seatings of the body 11' without bottoms are removed.

In the next station K7 the units 111, 11' move out and the capsules are closed. In stations K8 and K9 the closed capsules may for example be extracted from the carousel. In station K10 the seatings of the units 111, 11' may for example be cleaned, before new empty capsules are fed into these seatings, as already indicated in relation to the following stations K11 and K12.

It will be understood that in one or more stations immediately following station K6, if there are more than twelve stations the moveable units 111, 11' may remain in the retracted position and tablets, time-release constituents or other products may be introduced into the bottoms of the capsules through the open holes 2 located above the capsule bottoms loaded with the doses of product. Such matters can be thought up and readily put into effect by those skilled in the art. In such a case the sweeper wall 10 will extend to also include these stations, as indicated diagrammatically by the indefinite continuation in broken lines 10' in FIG. 4.

In at least the aforementioned station K5, where the desired compacting of the complete dose of product is carried out prior to its transfer to the capsule, the plungers may be fitted with force transducers capable of emitting an electrical signal proportional to the force exerted by the plungers on the carrots of product and this signal can be transmitted to the processor that controls the machine, which compares it with predetermined values to determine whether or not the density of carrots is within these values. If it is not, the processor emits signals which can be used for the automatic rejecting of capsules with incorrect doses of product, alerting the operator to the need to make corrections, and if required automatically performing these corrections if the adjusters 107 of the plungers 7 are servo-controlled. Station K6 may also use force transducers in order to measure the effort required to expel the carrots of product from the seatings of the dosing disc.

Figure 8:
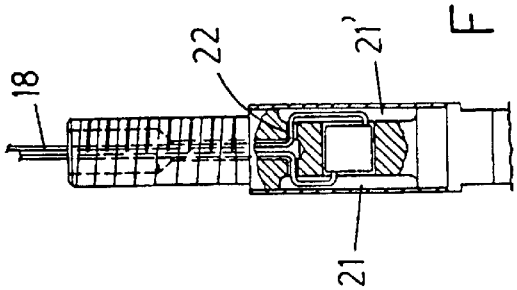
FIG. 8 illustrates further details viewed on the section marked VIII—VIII in FIG. 7.
Figure 7:
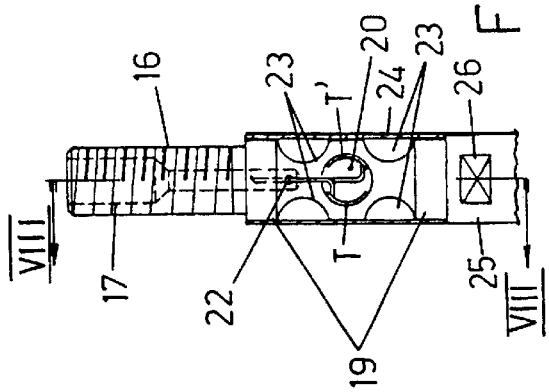
FIG. 7 is a side view showing details relating to the composition of some of the plungers of the machine according to the invention.

Referring to FIGS. 7 and 8, a possible embodiment of the sensors with force transducers associated with the plungers of station K5 or other stations will now be described. The plungers, which are replaced when the seatings of the dosing disc are changed, are mounted removeably by screwing the upper end in a seating in the adjustable supporting slide (not shown). The upper end of the plunger is a threaded upper section 16 of a sensor body. The sensor body has three cylindrical sections whose diameters increase in the downward direction. The upper section 16 is axially hollow as indicated at 17 for the passage of electrical conductors 18 connected to the transducers. The intermediate section 19 of the body contains in an intermediate position a transverse through hole 20 whose ends open on identical parallel opposite flat parts 21, 21'. At the top of these parts are the open ends of a small hole 22 parallel with hole 20 and intersecting the cavity 17 in order to take electrical conductors 18 connected to force transducers T, T' fixed to the internal side wall of the hole 20 which is then filled with a suitable electrically insulating self-curing resin.

Intermediate section 19 of the sensor body, in the intermediate portion that includes the flats 21, 21', has identical opposite semicylindrical recesses 23 at its extremities, the axes of curvature of these recesses 23 being parallel with the axis of hole 20. The function of recesses 23 is to give this section 19 of the sensor body sufficient elasticity so that when the plunger (which is contact with the sensor body) exerts a force on the dose of product which it is compressing into the holes of the dosing disc, the transducers T, T' detect an elastic microdeformation induced by the force in the walls of hole 20 containing them and emit an electrical signal of a value proportional to that of the said force. The intermediate section 19 of the sensor body may for example be covered by a bush 24 of some suitable material, e.g. plastic, which rests on the larger-diameter bottom section 25 of the plunger. The bottom section 25 is provided with opposite flats 26 or with a hexagonal passage for the engagement of a key for screwing or unscrewing the said threaded tail 16 into or out of its supporting seating.

What is claimed is:

1. A dosing machine with intermittent operation during a work cycle that is suitable for packaging doses of loose product in hard gelatin capsules, comprising:

a carousel mounted for rotation on a vertical axis, a holder mounted on top of said carousel and containing the product to be dosed, said holder having a top and a bottom, a fixed cover which covers the top of said holder, a disc which closes the bottom of said holder and which rotates with the carousel, said disc including on a periphery thereof, respective sets of vertical angularly equidistant through holes, and a respective top body located adjacent each said set of through holes and in which capsule tops are contained, said top bodies being fixed to said disc in a position for loading the capsules and for the stages of opening and then reclosing and discharging the capsules when filled, a respective flat hole-closing bottom body located under each respective said set of through holes of said disc, each said bottom body carrying bottom seatings for holding bottoms of the hard gelatin capsules and including an extension, respective radial slides which mount each said extension of the bottom body to said carousel, means for intermittently rotating said carousel about the vertical axis so that as an angular position of said disc intermittently changes, said slides are actuated to move said bottom body with the bottom seatings (a) from a position of alignment of the bottom seatings underneath said top seatings of said top body (b) to a position in which the bottom seatings are in line with said sets of holes of the disc, such that the bottoms of the capsules are filled with doses of the product, openings in the cover of the holder, respective sets of plungers which traverse said openings of said cover and which occupy a part of a circle concentric with the rotation axis of the carousel, associated height adjusters to which respective said sets of plungers are mounted, a turret to which said height adjusters are mounted and which is lowered and raised in phase with the intermittent rotation of said carousel, first ones of said sets of plungers being located partly so as to interfere with the product in the holder so as progressively to compress the corresponding quantities of product into underlying said sets of through holes, and a fixed sweeper wall of said holder outside of which there is no product, such that second ones of said sets of plungers are located outside of said sweeper wall and perform final stages of the work cycle including transferring of doses of the product from said through holes to the capsule bottoms.

2. A dosing machine according to claim 1, wherein said disc includes a peripheral annular part which is lower than an adjacent lower face of the disc and in which the sets of through holes are open at a bottom thereof, such that said bottom bodies only contact the bottom of said peripheral annular part during movement thereof.

3. A dosing machine according to claim 2, wherein the holes of each set of holes of the disc are arranged in a layout of a plurality of rows with the holes of one row staggered with respect to those of the adjacent row, and wherein the sets of plungers, the bottom seatings and the top seatings are positioned with the layout, such that when the bottom bodies are moved to the position where the bottom seatings are in line with the sets of through holes, each through hole lines itself up with a corresponding bottom seating without passing over other bottom seatings.

4. A dosing machine according to claim 1, further including opposing means which operate under one of said bottom bodies or the associated slides when the bottom bodies are in the position in which the bottom seatings are in line with the sets of the through holes, in order to oppose a force applied to the bottom bodies by the associated plungers on descent strokes thereof.

5. A dosing machine according to claim 4, which said opposing means are rollers supported rotatably by the turret.

6. A dosing machine according to claim 4, in which one of said bottom bodies or the associated slides are given a very small amount of play in the vertical direction (a) which ensures perfect contact between the bottom bodies and the disc when said opposing means are operating, and (b) which ensures a small amount of play between the bottom bodies and the disc when said opposing means are not operating, so as to permit an almost frictionless radial movement of the bottom bodies relative to the disc.

7. A dosing machine according to claim 1, wherein the first ones of said sets of plungers in the product are laid out in stations, including a final station of plungers which fills a remaining space in the sets of holes with product up to a top edge thereof, and wherein the second ones of the sets of plungers located outside of the sweeper wall are laid out in stations, including (a) a compression station of plungers which compresses to a desired density a final dose of product, and (b) a final station of plungers which expels the final dose of product from the disc, such that with a single said disc it is possible, by adjusting the height adjusters of the sets of plungers to form doses of product that vary in density, mass and height as desired.

8. A dosing machine according to claim 7, wherein at least the second ones of the sets of plungers of the compressing station include respective force sensors which emit an electrical signal proportional to an axial force applied by the second ones of the sets of plungers of the compressing station to the pressed product dose, and further including a control processor that controls the operation of the machine and which receives the signals from the force sensors, which said processor compares the signals with predetermined values for an automatic and selective check of a mass of the product doses, such that if the check produces negative results, the processor then sends commands for the automatic rejection of the capsules with incorrect doses of product and sends instructions for activation of a warning signal.

9. A dosing machine according to claim 8, wherein the second ones of the sets of plungers of the final station where the final doses of product are expelled from the disc likewise include respective force transducers which measure a resistance to discharging of the doses and which transmit a signal indicative thereof to the control processor.

10. A dosing machine according claim 9, wherein the second ones of the sets of plungers to which the force sensors are fitted are each positioned so that an upper end is part of a body of each said force sensor which said upper end is mounted in the respective height adjusters supporting each of the second ones of the sets of plungers, wherein each said second one of the sets of plungers includes a sensor body, each said sensor body including (a) said upper part, (b) an intermediate part which includes a transverse through hole in the intermediate part, symmetrical transverse weight-reducing recesses in the intermediate part, said recesses being located above and below said through hole in such a way as to give said intermediate part of the sensor body with the through hole elasticity, a fixing means for fixing two force sensors to a wall inside the through hole, a fill material which fills the through hole, which keeps the force sensors in position, and which preloads the force sensors, electrical conductors of the force sensors which pass out through said through hole, longitudinally flattened sections adjacent said through hole and along which said electrical conductors pass, and transverse holes at the upper end of the flattened sections which have open ends through which said electrical conductors pass, and an axial hole which leads into the transverse holes through which said electrical conductors run out at a top end of said intermediate part and said upper part, and (c) a protective bush located about said intermediate part.

11. A dosing machine according to claim 10, wherein said fill material is a self-curing resin.

12. A dosing machine according claim 8, wherein the first ones of the sets of plungers to which the force sensors are fitted are each positioned so that an upper end is part of a body of each said force sensor which said upper end is mounted in the respective height adjusters supporting each of the first ones of the sets of plungers, wherein each said first one of the sets of plungers includes a sensor body, each said sensor body including (a) said upper part, (b) an intermediate part which includes a transverse through hole in the intermediate part, symmetrical transverse weight-reducing recesses in the intermediate part, said recesses being located above and below said through hole in such a way as to give said intermediate part of the sensor body with the through hole elasticity, a fixing means for fixing two force sensors to a wall inside the through hole, a fill material which fills the through hole, which keeps the force sensors in position, and which preloads the force sensors, electrical conductors of the force sensors which pass out through said through hole, longitudinally flattened sections adjacent said through hole and along which said electrical conductors pass, and transverse holes at the upper end of the flattened sections which have open ends through which said electrical conductors pass, and an axial hole which leads into the transverse holes through which said electrical conductors run out at a top end of said intermediate part and said upper part, and (c) a protective bush located about said intermediate part.

13. A dosing machine according to claim 12, wherein said fill material is a self-curing resin.

14. A dosing machine according to claim 8, further including an adjustment means for the automatic adjustment of the heights of the sets of plungers; and wherein said processor where the check produces negative results sends an instruction to said adjustment means to adjust the height of the sets of plungers to produce doses of product with acceptable characteristics of mass.

15. A dosing machine according to claim 1, wherein the sets of plungers are provided with adjusters of one of selective or centralized type, and with one of manual control or servocontrol thereof.

16. A dosing machine according to claim 1, wherein the holder for the product includes a portion of toric shape, wherein the holder is formed by the disc which turns with the carousel and an outer lateral wall integral with the disc and the sweeper wall and an inner lateral wall which are integral with the cover which is fixed.

17. A dosing machine according to claim 16, further including a central fixed shaft about which said carousel rotates, and wherein the cover is integral with said central shaft.

18. A dosing machine according to claim 1, wherein the sweeper wall of the holder of the product has an extension such that, in a space isolated by this sweeper wall from the product, and wherein one or more auxiliary stations operate in the space after the doses of product are transferred into the capsule bottoms and when these capsule bottoms are in line with the corresponding sets of through holes, said auxiliary stations inserting other products into the capsule bottoms.

* * * * *